US008858408B2

(12) United States Patent
DeMeo

(10) Patent No.: US 8,858,408 B2
(45) Date of Patent: Oct. 14, 2014

(54) DOUBLE LOOP EXERCISE STRAP

(75) Inventor: Ronald F. DeMeo, Fort Lauderdale, FL (US)

(73) Assignee: Meridian Research and Development, Inc., Fort Lauderdale, FL (US)

( * ) Notice: Subject to any disclaimer, the term of this patent is extended or adjusted under 35 U.S.C. 154(b) by 97 days.

(21) Appl. No.: 13/312,842

(22) Filed: Dec. 6, 2011

(65) Prior Publication Data

US 2013/0143724 A1 Jun. 6, 2013

(51) Int. Cl.
*A63B 21/00* (2006.01)
*A63B 22/00* (2006.01)
*A61H 3/00* (2006.01)

(52) U.S. Cl.
USPC ..... 482/131; 482/69

(58) Field of Classification Search
USPC ..... 482/51, 69, 92, 121, 122, 124, 131, 93, 482/105–106; 182/6, 3; 2/308–310, 2/312–317, 321–323, 331, 338
See application file for complete search history.

(56) References Cited

U.S. PATENT DOCUMENTS

| | | | | | |
|---|---|---|---|---|---|
| 2,574,178 | A | * | 11/1951 | Haller | 182/3 |
| 3,295,517 | A | * | 1/1967 | Stevens | 602/19 |
| 4,056,852 | A | | 11/1977 | Greendale | |
| 4,527,289 | A | * | 7/1985 | Shea | 2/322 |
| 4,984,786 | A | * | 1/1991 | Lemke et al. | 482/105 |
| 5,147,261 | A | * | 9/1992 | Smith et al. | 482/106 |
| 5,279,386 | A | * | 1/1994 | Cearley | 182/3 |
| 5,403,253 | A | * | 4/1995 | Gaylord | 482/43 |
| 5,411,461 | A | * | 5/1995 | Thomascik | 482/124 |
| 5,615,750 | A | * | 4/1997 | Phillips | 182/6 |
| 5,820,533 | A | * | 10/1998 | Goldman | 482/124 |
| 6,050,364 | A | * | 4/2000 | Popall et al. | 182/6 |
| 6,732,834 | B2 | * | 5/2004 | Colorado | 182/6 |
| 6,755,755 | B2 | * | 6/2004 | Wah Loh | 473/458 |
| 7,004,892 | B2 | * | 2/2006 | Marco | 482/124 |
| 7,445,085 | B2 | * | 11/2008 | Petzl et al. | 182/6 |
| 7,490,610 | B2 | * | 2/2009 | Franklin | 128/875 |
| 7,575,136 | B2 | * | 8/2009 | Kernkamp | 224/159 |
| 7,707,652 | B2 | * | 5/2010 | Senegal | 2/102 |
| 7,785,243 | B2 | * | 8/2010 | Kassel | 482/122 |
| 8,267,839 | B1 | * | 9/2012 | Bartolotta | 482/79 |
| 8,322,488 | B2 | * | 12/2012 | Green | 182/3 |

(Continued)

OTHER PUBLICATIONS

Internet Advertisement for TRX—http://www.training.com/products/trx-boot-camp-ropes-straps-round-2 (4 pages).

(Continued)

*Primary Examiner* — Stephen Crow
*Assistant Examiner* — Garrett Atkinson
(74) *Attorney, Agent, or Firm* — Sideman & Bancroft, LLP; Guy W. Chambers

(57) ABSTRACT

A double loop exercise strap that includes both an outer strap anchored to a fixed object (e.g., a wall, rail or other fixed platform) and an inner strap that wraps firmly around a limb, extremity (e.g., hand or foot) or torso of the human body. The inner strap has two ends, a fixed end that may advantageously be sewn or attached to the outer strap and a free end that wraps around the human limb, extremity or torso and is threaded through an outer strap slot before being attached to the outside of the outer strap using VELCRO™, buckles or other types of fasteners to thereby create a closed double loop system.

11 Claims, 14 Drawing Sheets

(56) References Cited

U.S. PATENT DOCUMENTS

| | | | | |
|---|---|---|---|---|
| 2001/0047904 | A1* | 12/2001 | Antonio | 182/3 |
| 2003/0027698 | A1* | 2/2003 | Matsuoka | 482/124 |
| 2003/0130098 | A1* | 7/2003 | Marco | 482/124 |
| 2005/0227833 | A1* | 10/2005 | Wilkinson | 482/124 |
| 2005/0251895 | A1* | 11/2005 | Farrah et al. | 2/227 |
| 2005/0263102 | A1* | 12/2005 | Sherman et al. | 119/792 |
| 2006/1020557 | | 9/2006 | Harrison et al. | |
| 2006/0282947 | A1* | 12/2006 | King | 5/104 |
| 2007/0142185 | A1* | 6/2007 | Woodman et al. | 482/69 |
| 2007/0149368 | A1* | 6/2007 | Koch | 482/131 |
| 2007/0213186 | A1* | 9/2007 | Longo | 482/121 |
| 2010/0041528 | A1* | 2/2010 | Todd | 482/124 |
| 2010/0096419 | A1* | 4/2010 | Stephens | 224/153 |
| 2014/0005015 | A1* | 1/2014 | Hester | 482/131 |

OTHER PUBLICATIONS

Internet Advertisement for Ab-Straps—http://www.power-systems.com/p-4944-perfectstraps.aspx (3 pages).

* cited by examiner

DOUBLE LOOP EXERCISE STRAP

FIELD OF INVENTION

The present invention relates to exercise equipment. More specifically, the present invention relates to an exercise device that firmly secures human limbs, extremities and/or torsos to resistance bands, suspension straps and stretch straps used in various exercise protocols and therapeutic applications.

BACKGROUND OF THE INVENTION

Resistance bands, suspension straps and stretch straps have become popular among exercisers, personal trainers and physical therapist alike. As simple, low cost devices and an alternative to high cost weight systems, they have become a standard piece of exercise equipment in any gym or physical therapy office.

There are two commonly used forms of resistance bands. The most common resistance band consists of rubber tubing of about five feet in length with handles on one end and a connector at the other end to secure the resistance band to an anchoring device. Another type of resistance band is a flat band about four inches wide that comes in rolls. The flat bands are most commonly used in physical therapy where varying lengths and strengths are cut and used for therapeutic exercises.

Suspension straps have recently grown in popularity, particularly for bodyweight training. Such suspension straps are usually made of nylon anchored to a fixed object and are of sufficient strength to support a person's weight. They generally consist of three components. On one end, there is the anchoring portion of the strap, usually a clip of some type. The middle portion is several feet of nylon strap to support a person's weight. At the other end, there is a handle. In a gym setting, suspension straps are typically anchored to the ceiling, A-frames, weight machines, walls and, sometimes, the floor. The user usually fastens the suspension strap to the anchoring device by either wrapping the strap around the anchoring device or locking it into place with a carabineer or with a clip hook connected directly to a closed loop anchor. These straps can be adjusted by either buckles or strap extenders. Although there are many companies marketing and selling suspension straps, the most popular is the TRX™ Suspension Trainer™ from Anytime Fitness.

Another popular therapeutic exercise device is the stretch strap. To use a stretch strap, the body is put into a lever position to lengthen the muscle being stretched. A buckle is used to form a closed loop at one end to anchor the strap to a foot or wrist. Once the foot or wrist is anchored, the user pulls the other end of the strap to execute the stretch.

There are a number of key deficiencies in these three forms of exercise bands. Many of these exercise bands have open loops, slings, or handles that do not properly secure the limb, extremity or torso. This is particularly true among the "ab" or ankle straps. When strapped in the vertical position, for example, a person can easily fall out of such loop, sling or handle. Furthermore, an open loop, sling or handle puts a tremendous amount of pressure on the joints and, in many cases, may cause injury to joints. This is particularly a problem with people having weaker joints or a weak grip. If a person has a weak joint, it further exposes them to injuries, especially, injury to the elbow, ankle or knee joints. Whether it's the TRX, cables, or free weights, the user must use either the wrist or ankle joint to apply resistance to the more proximal muscle group or trunk/core muscles. Hence the smallest, weakest, and most distal joints are almost always used. Additionally, when comparing a force vector analysis of a movement such as a bench press, the total resistance applied at the palm is dissipated as it reaches the chest. Any weakness of any joint in the path will then set the upper limit on how much resistance can be delivered to the target muscle. Since the plane of movement of the upper extremity, for example, is limited by the sum of all the other joints, such as the elbow and shoulder, the angle of force is more in the horizontal plane. Moreover, the current exercise band design does not transfer the suspended weight directly to the core muscle group that is of interest to build or strengthen.

BRIEF SUMMARY OF THE INVENTION

In its preferred form, the present invention provides a double loop exercise strap that includes both an outer strap anchored to a fixed object (e.g., a wall, rail or other fixed platform) and an inner strap that wraps firmly around a limb, extremity (e.g., hand or foot) or torso of the human body. The inner strap preferably has two ends, a fixed end that may advantageously be sewn or otherwise attached to the outer strap and a free end that wraps around the human limb, extremity or torso and is threaded through an outer strap slot before being attached to the outside of the outer strap using VELCRO™, buckles or other types of fasteners to thereby create a closed double loop system.

In another aspect, the present invention can be used with a double ringed strap that further increases the applicability of the closed double loop system to exercise bands that have handles. Such an embodiment is particularly advantageous for persons with disabilities. In other embodiments, the present invention can be greatly increased in size, for example, for use in hoists to lift heavier items such as heavy equipment, construction materials, cars and boats. It can also be used to attach the strap to a bar or handle such as a dumbbell of barbell.

Numerous embodiments of the present invention provide a more secure, efficient and effective exercise strap. The closed double loop system of the present invention can be attached to a variety of exercise devices, including, but are not limited to, resistance bands, cable machines, dumbbells, barbells, suspension straps and stretch straps. For convenience, the bands and straps are collectively referred to herein as "exercise bands." Significantly, the present invention is easy and safe to use.

In brief, the present invention is an exercise strap that satisfies a need in the industry for a more efficient exercise regimen that results in increased safety, reduced injuries and more effective weight loading to the core muscle groups. This significantly reduces the risk of injury, allows more efficient transfer of resistance to the target muscle and also allows different planes of movement.

It is to be understood that both the foregoing general description and the following detailed description are exemplary and intended to provide further explanation of the invention as claimed.

DETAILED DESCRIPTION OF THE INVENTION

Figure 1A:
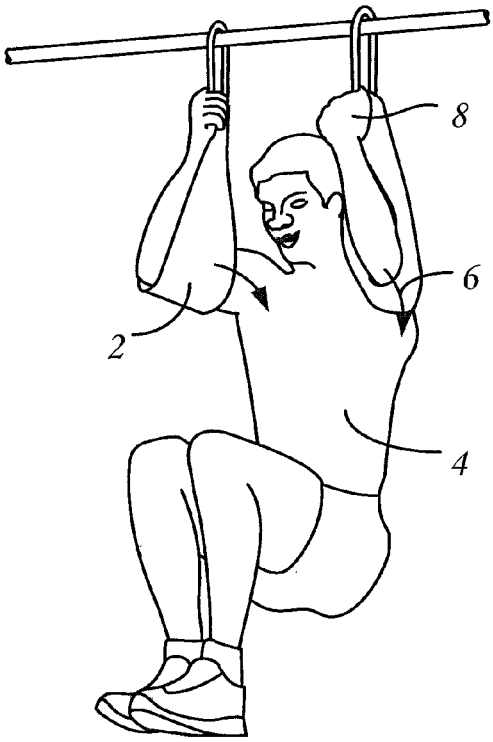
FIG. 1A PRIOR ART
FIG. 1A shows an upright person using an open loop sling of the prior art.
Figure 1B:
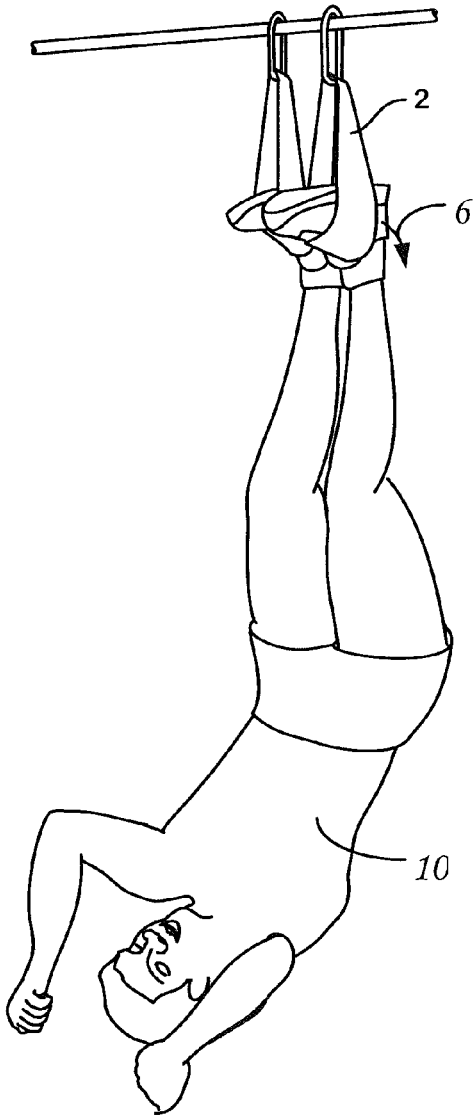
FIG. 1B PRIOR ART
FIG. 1B shows an upside down person using an open loop sling of the prior art.

FIGS. 1A-1B illustrate a prior art open loop sling 2 known as the "Ab Strap." These figures also illustrate how such an open loop sling 2 places the exerciser 4 in a dangerous situation. As the force arrows 6 illustrate, the exerciser has a tendency to fall out the open loop sling 2. To avoid doing so, the exercise must grip the open loop sling 2 at the top 8 with his/her hands. When the open loop sling is used by an upside down exerciser 10 as shown in FIG. 1B, the exerciser's feet have little or no gripping option and can easily fall out of the open loop sling 2. As described herein, the present invention remedies this situation with a device that is far easier and safer to use in such applications.

FIGS. 1A-1B also illustrate how nearly all weight-bearing exercises with open loop slings 2 of the prior art require the use of either the wrist or ankle joint to perform. Anatomically, the wrist and ankle joints are composed of smaller bones and weaker muscles that experience a tremendous amount of pressure on smaller surface areas when exercises are done with open loop slings 2. As such, these smaller joint are prone to injuries. As described below, the present invention also addresses these problems by removing or reducing the pressure exerted on these weak, vulnerable joints by shifting the weight to larger, more appropriate body parts.

FIGS. 2-5 illustrate a preferred form of the closed double loop strap 12 of the present invention. The closed double loop strap 12 includes two basic components—an outer loop 14 and an inner strap 16. Both the outer loop and inner strap are preferably made of a durable fabric, such as the heavy nylon commonly used for climbing harnesses or polyester, polyethylene fibers, aramid fibers and/or leather. The outer loop 14 is usually attached to a connector such as a clip, hook or carabineer. In this embodiment, the outer loop 14 is attached to a clip or carabineer 18. The bar, hook or carabineer 18 is then typically attached to an exercise band which is in turn attached to a ceiling, wall, A-frame or floor. When the inner strap 16 is in an open configuration as shown in FIG. 2A, a limb, extremity or torso may be comfortably placed through or into the outer loop 14. In most cases, the outer loop 14 is considerably larger in diameter than a limb, extremity or torso.

Figure 2A:
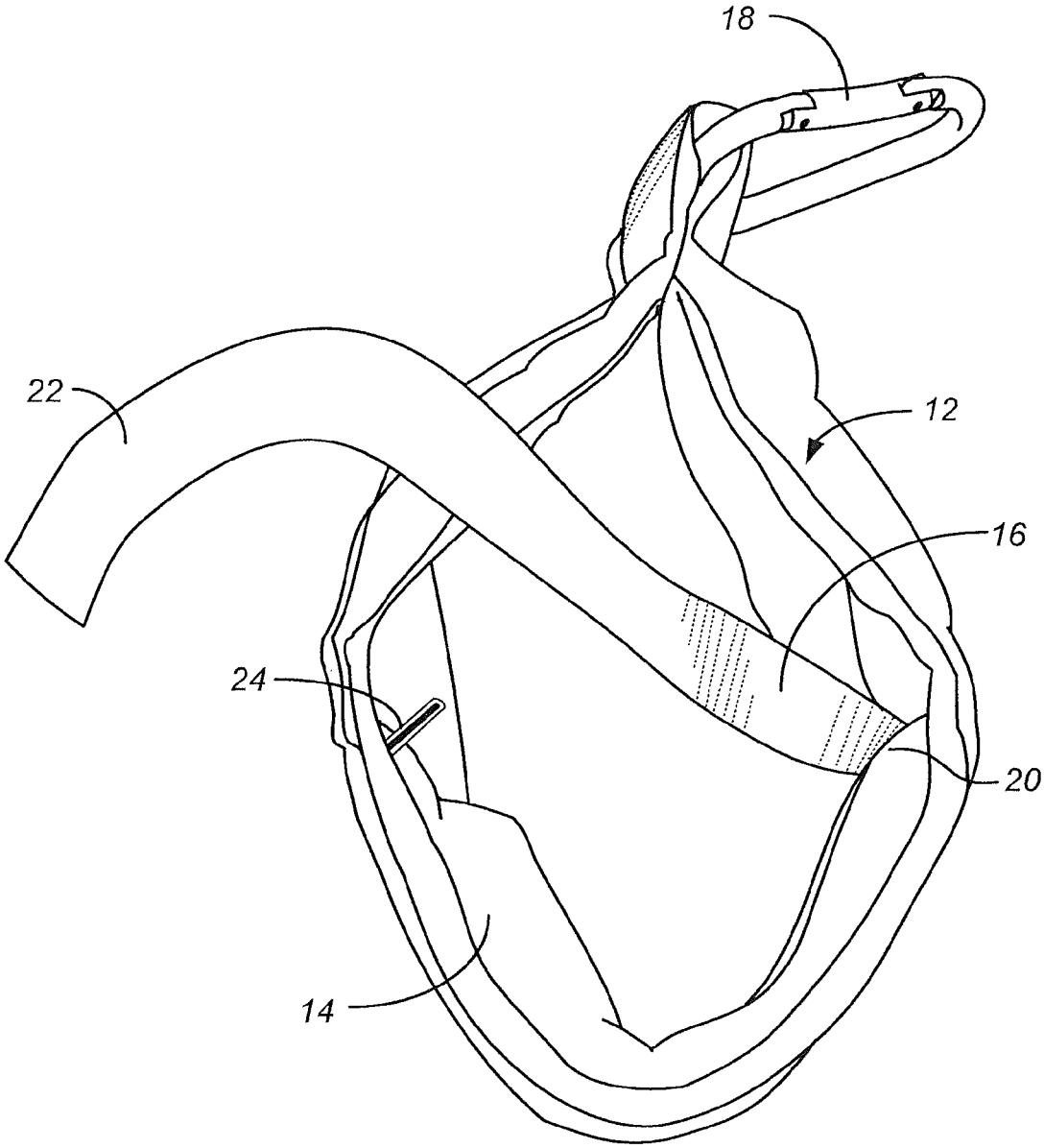
FIG. 2A illustrates the closed double loop system of the present invention with the inner strap having a free end.
Figure 2B:
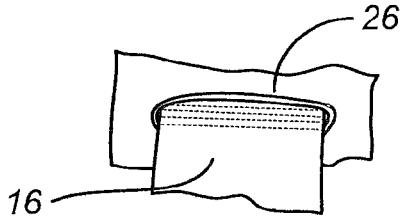
FIG. 2B shows a close up of the inner strap free end when it is threaded through a slot in the outer strap.

In a preferred embodiment, the inner strap 16 has two ends, a fixed end 20 which is permanently attached to the outer loop 14, usually by being sewn onto the inside of the outer loop 14, and a free end 22, which can be separated from the outer loop 14. FIG. 2A also shows a slot 24 on the opposite side of the outer loop 14 from the fixed end 20. The fixed end 20 and the slot 24 are preferably positioned about mid-way in the outer loop 14. The slot 24 is also preferably reinforced with, for example, additional stitching 26 around it. FIG. 2B illustrates in a close up view how the inner strap 16 can be fed through the slot 24 in the outer loop 14. In an alternative and less preferred embodiment, the inner strap 16 can have two free ends 22 and two slots 24 (not shown) where both free ends 22 wrap around the limb extremity or torso, are fed through respective slots 24 and are then attached to the outside of the outer loop 14 in the manner shown in FIGS. 3-5.

Figure 3:
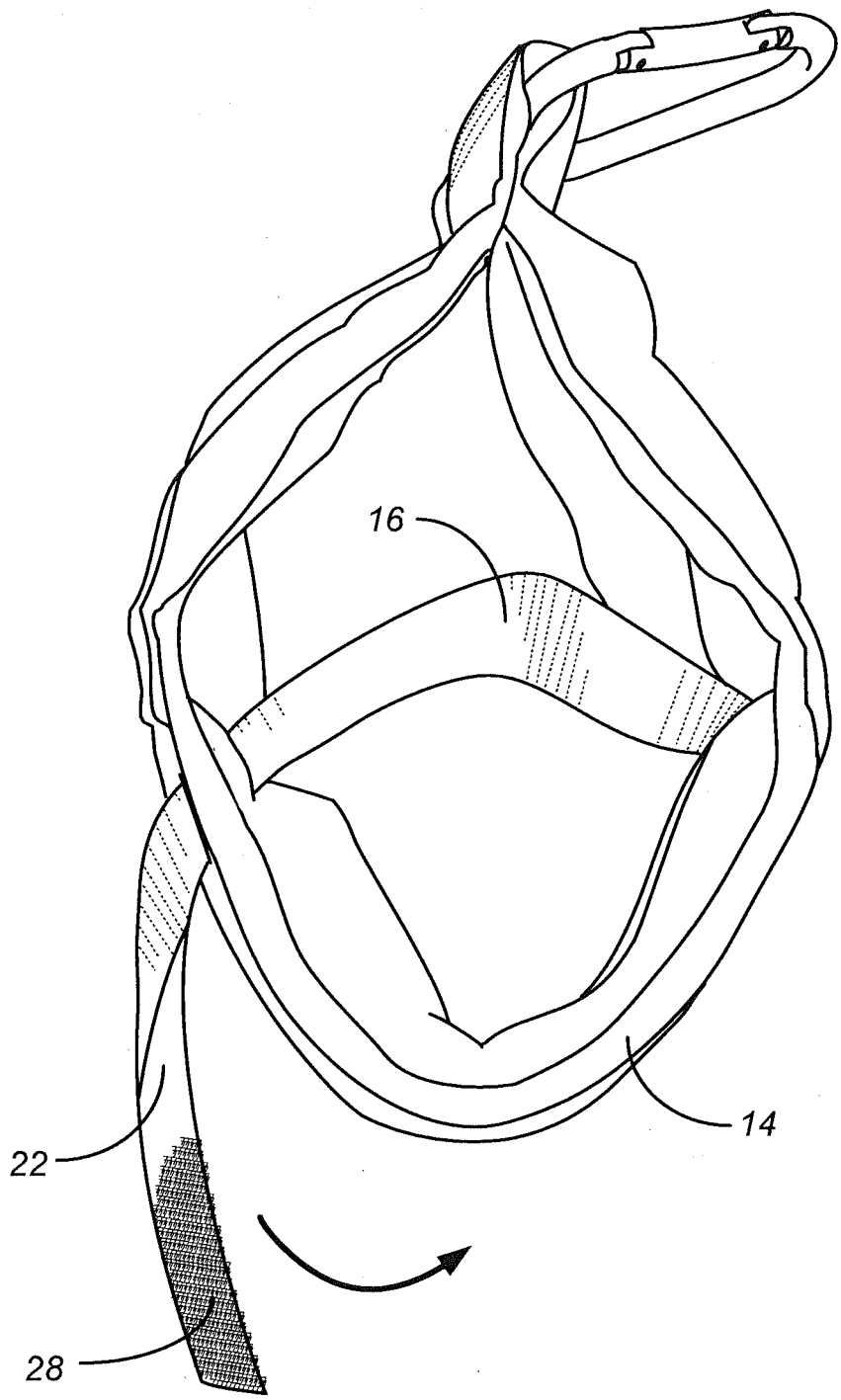
FIG. 3 shows the complete closed double loop system of the present invention when the free end of the inner strap is threaded through a slot in the outer strap.
Figure 4:
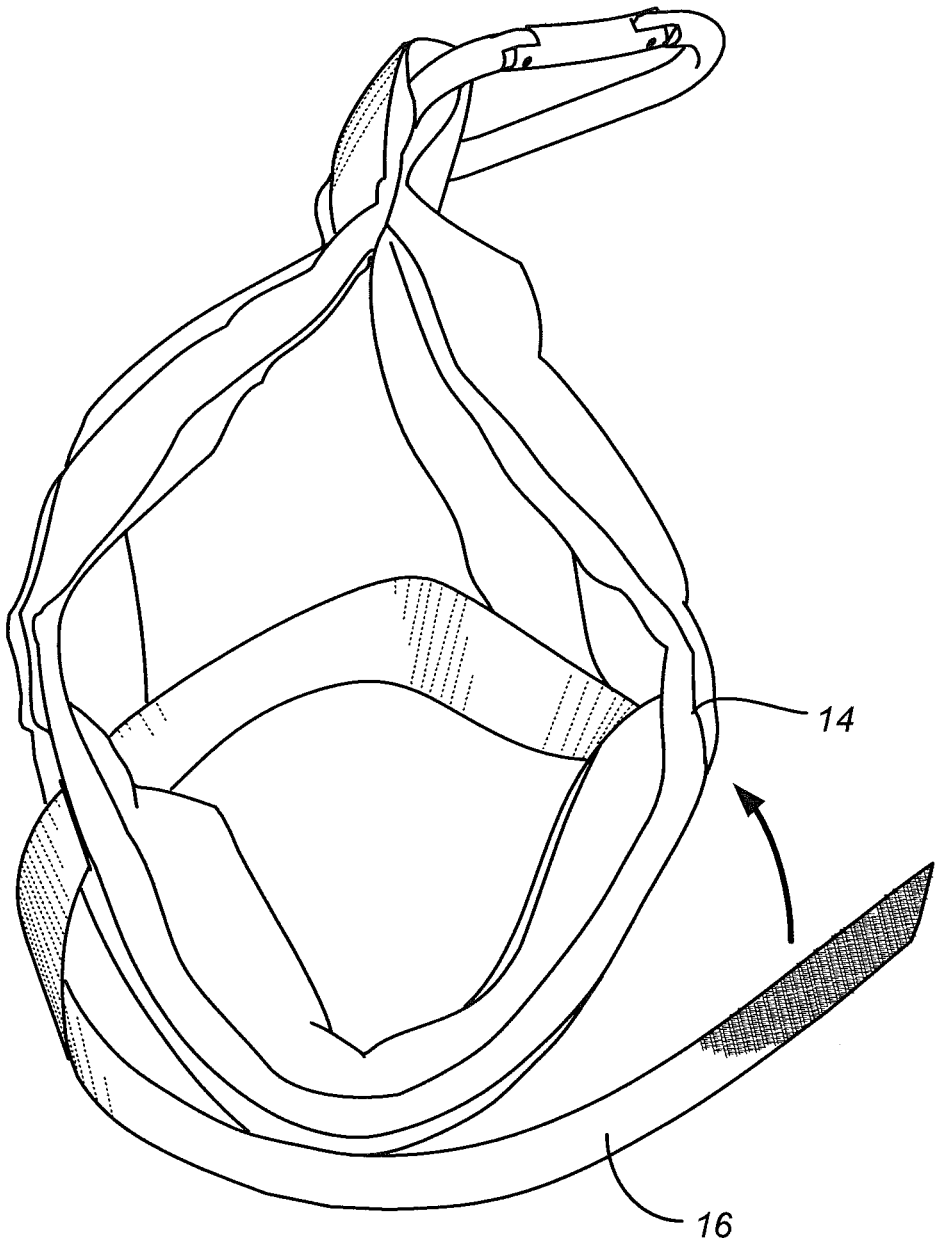
FIG. 4 shows how the free end of the inner strap can be attached to the outside of the outer strap.
Figure 5:
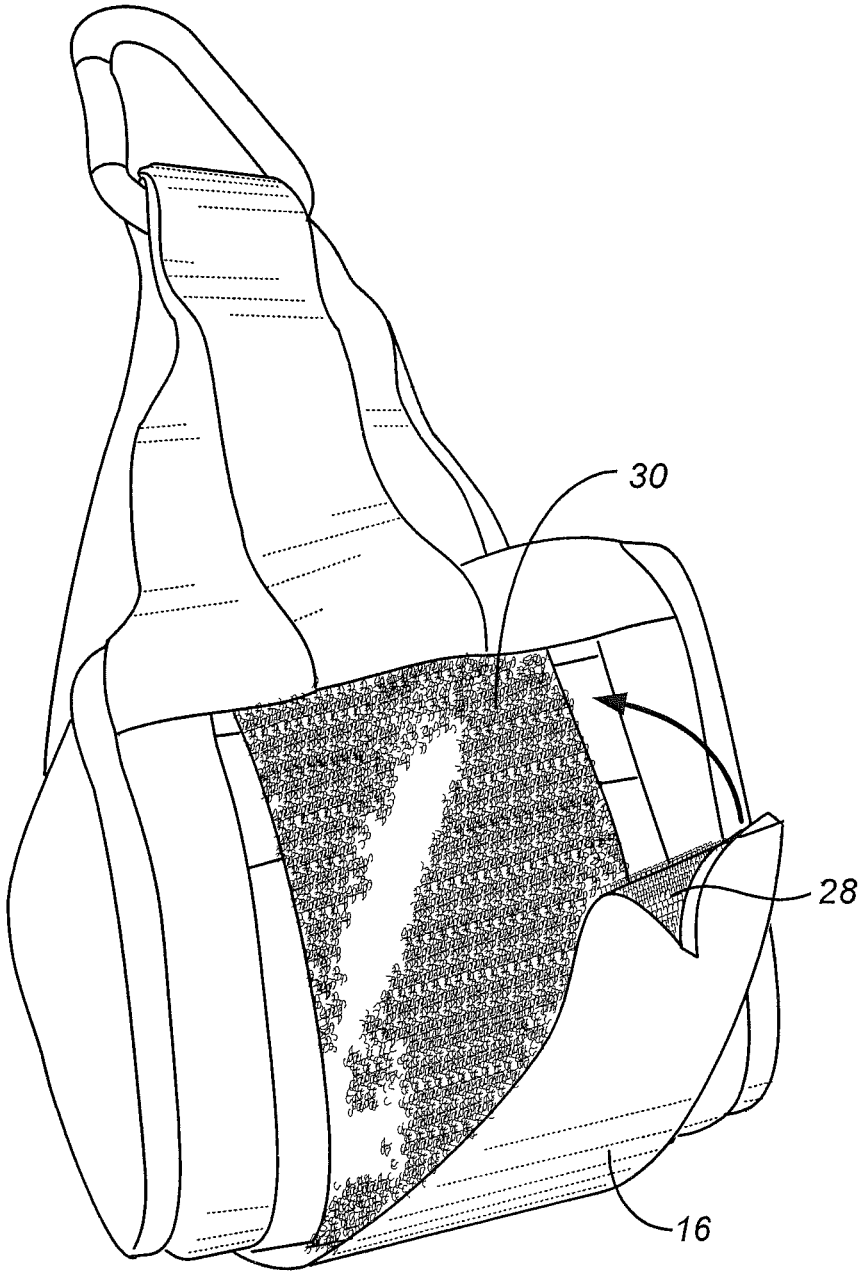
FIG. 5 shows the use of VELCRO™ to attach the free end of the inner strap to the outside of the outer strap.

FIG. 3-5 illustrates how the free end 22 of the inner strap 16 in the preferred embodiment can be wrapped around the outside of the outer loop 14. FIGS. 3-5 also illustrates how VELCRO™ hooks and loops 28 can be used as fasteners at the free end 22 of the inner strap 16 and the outside 30 of the outer loop 14. The VELCRO™ hooks can be on the free end 22 of the inner strap 16 with the VELCRO™ loops 30 being on the outside 30 of the outer loop 14, or vice versa. When the inner strap 16 has wrapped firmly around a limb, extremity or torso and preferably reaches about mid-way up the outside the outer loop 14 as shown in FIG. 4, the free end 22 of the inner strap 16 is pressed against the outside of the outer loop 14. In a preferred embodiment, FIG. 5 illustrates the final attachment of the inner strap 16 VELCRO™ to the outer loop 14 VELCRO™. While VELCRO™ is preferably used as a fastener in the present invention, alternative fastening mechanisms may also be used such as clips, belts, buckles, snaps and other fastening systems.

Figure 6A:
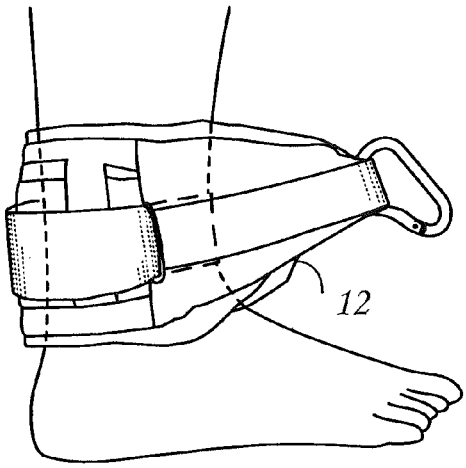
FIG. 6A illustrates the closed double loop system of the present invention attached to an ankle.
Figure 6B:
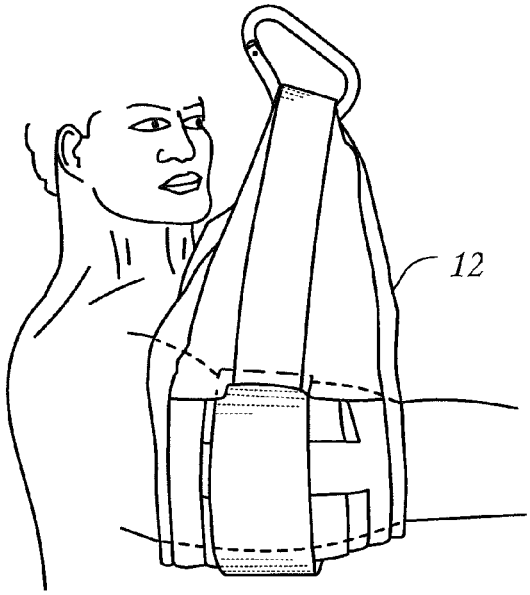
FIG. 6B shows the closed double loop system of the present invention attached to an upper arm.
Figure 6C:
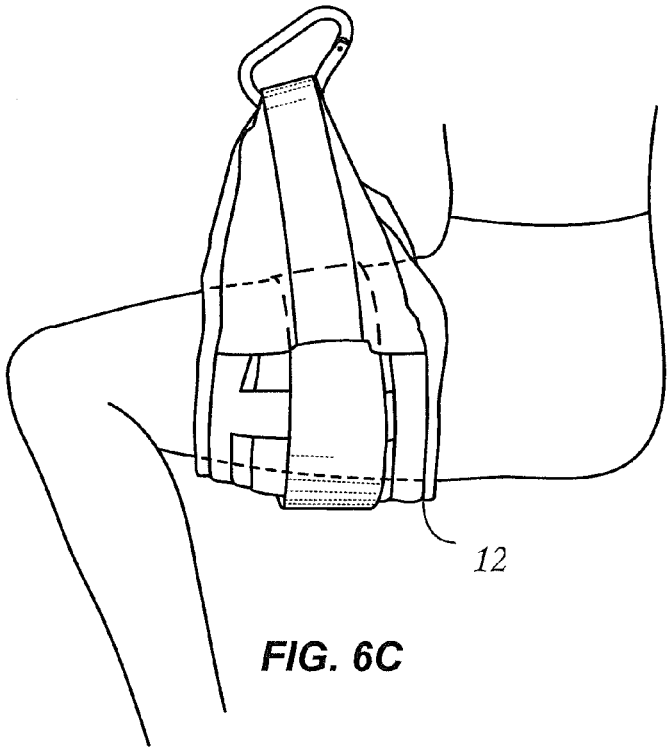
FIG. 6C illustrates the closed double loop system of the present invention attached to a thigh.

FIGS. 6A-6C illustrates the various uses of the closed double loop strap 12 of the present invention. As shown in FIG. 6A, the closed double loop strap 12 can be attached to the foot or ankle. When used on the foot or ankle, the closed double loop strap 12 tightly secures either the foot or ankle and avoids the perilous and dangerous situation illustrated in FIG. 1B. When used on an arm as shown in FIG. 6B, the exerciser no longer has to grip the upper portion of the strap as shown in FIG. 1A and can focus instead on exercising his/her abdominal muscles. The closed double loop strap 12 of the present invention can further be used on a thigh as shown in FIG. 6C.

The preceding examples illustrate how the closed double loop strap 12 of the present invention reduces strain during exercise on smaller, weaker joints such as wrists, elbows and ankles. When doing a shoulder press with the closed double loop strap 12, for example, an exerciser can rotate the shoulder joint during the upward press to allow different heads of the deltoid to be trained in the same exercise. Since the force of the resistance is not transmitted to the forearm, elbow and triceps, nearly all of the resistance can be shifted to the deltoid and torso core. When doing so, this will reduce injury to smaller joints and allow more effective loading to the torso muscles. Moreover, the closed double loop strap 12 of the present invention can advantageously be used in the high intensity repetitious training exercises described in the inventor's co-pending U.S. patent application Ser. No. 12/913,678, the disclosure of which is hereby incorporated by reference.

Figure 7:
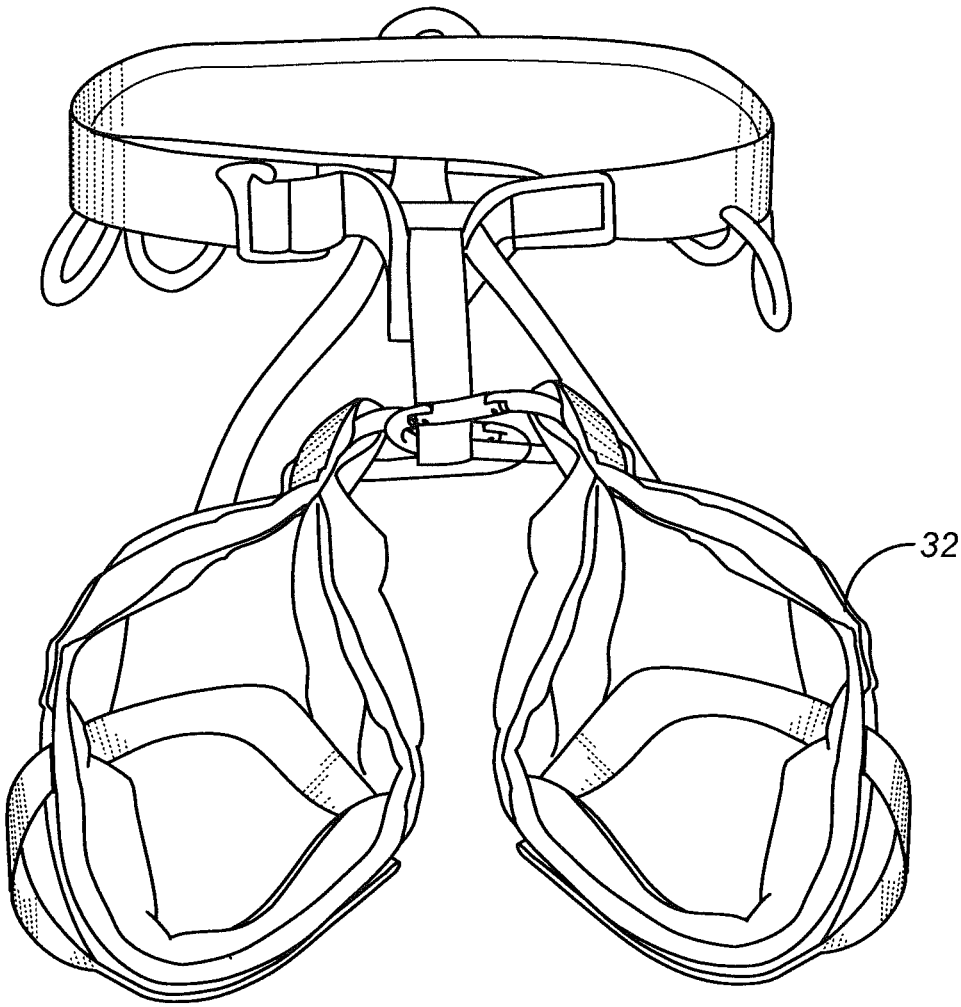
FIG. 7 shows the closed double loop system of the present invention in a climbing harness.

The present invention can also improve a "climbing" or "zip line" harness 32 as shown in FIG. 7. In this "climbing" or "zip line" application, the closed double loop strap of the present invention can tighten the leg straps of the "climbing" or "zip line" harness 32, thereby, improving the safety of the "climbing" or "zip line" harness.

Figure 8A:
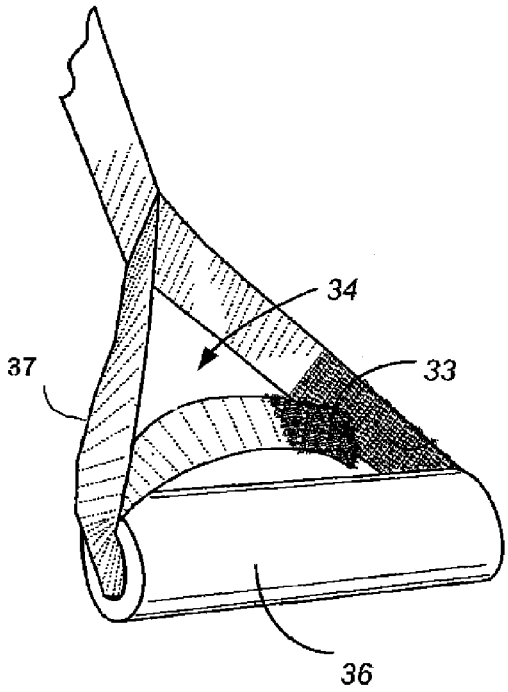
FIG. 8A shows an alternative embodiment of the closed double loop system as applied to exercise handles.
Figure 8B:
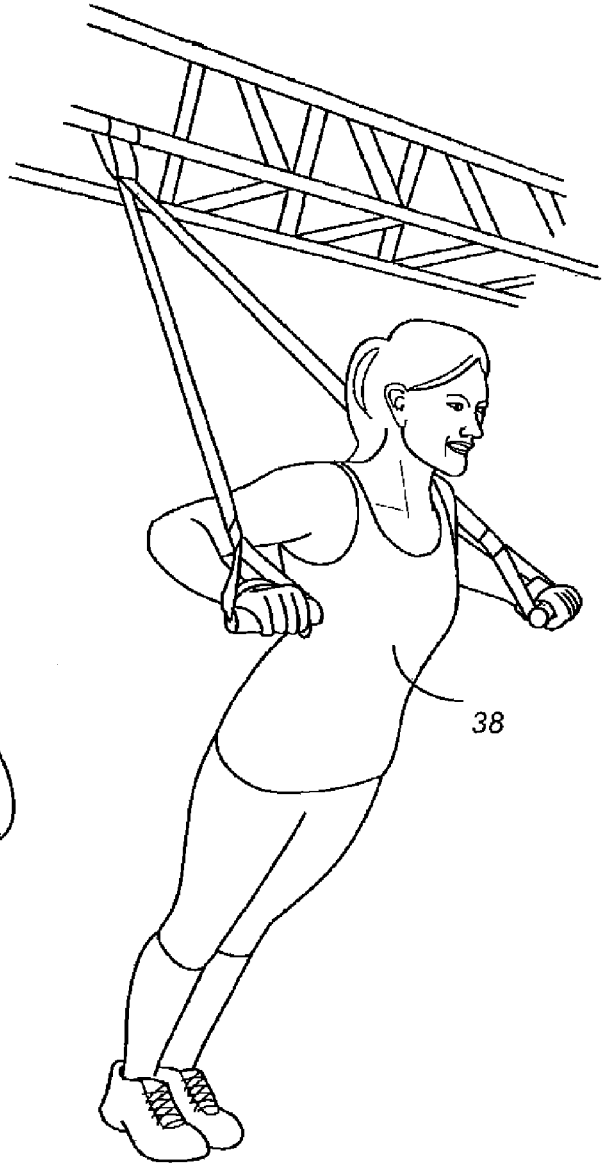
FIG. 8B shows a person suspended on an exercise band with closed double loop handles of the present invention.

Another embodiment of the present invention can be seen in FIG. 8A-8B where a modified closed double loop strap 34 invention can placed inside an exercise handle 36, such as the handle of the TRX™ Suspension Trainer™. As shown in FIG. 8B, the user 38 is suspended at various angles with the TRX™ system and moves their body weight in different planes. Since the user's body weight is fixed, the resistance is also fixed. In theory, changing the angle varies resistance. When a user cannot propel their weight and change their angle, they cannot perform the movement. Since the TRX™ system extensively uses the wrists and ankles, there is sometimes an inability to use the TRX™ system by exercisers with weak joints. It is not uncommon for a user to easily fall out of the TRX™ system by losing their grip. In the embodiment shown in FIG. 8A, an inner strap 33 of the present invention is wrapped around the user's hand and secured through the use of VELCRO™ to the outer strap 37 of the handle 36. In so doing, the inner strap 33 can better secure an exerciser in a suspended position shown in FIG. 8B.

Figure 9A:
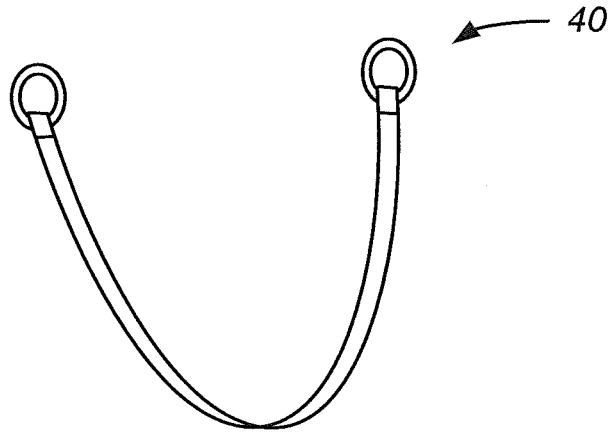
FIG. 9A shows a double ring strap for use with the present invention.
Figure 9B:
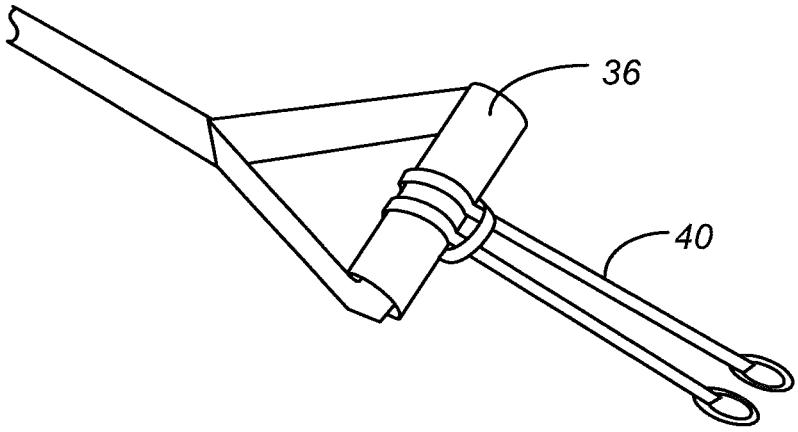
FIG. 9B illustrates how a double ring strap can attach to the handles of an exercise band.
Figure 10:
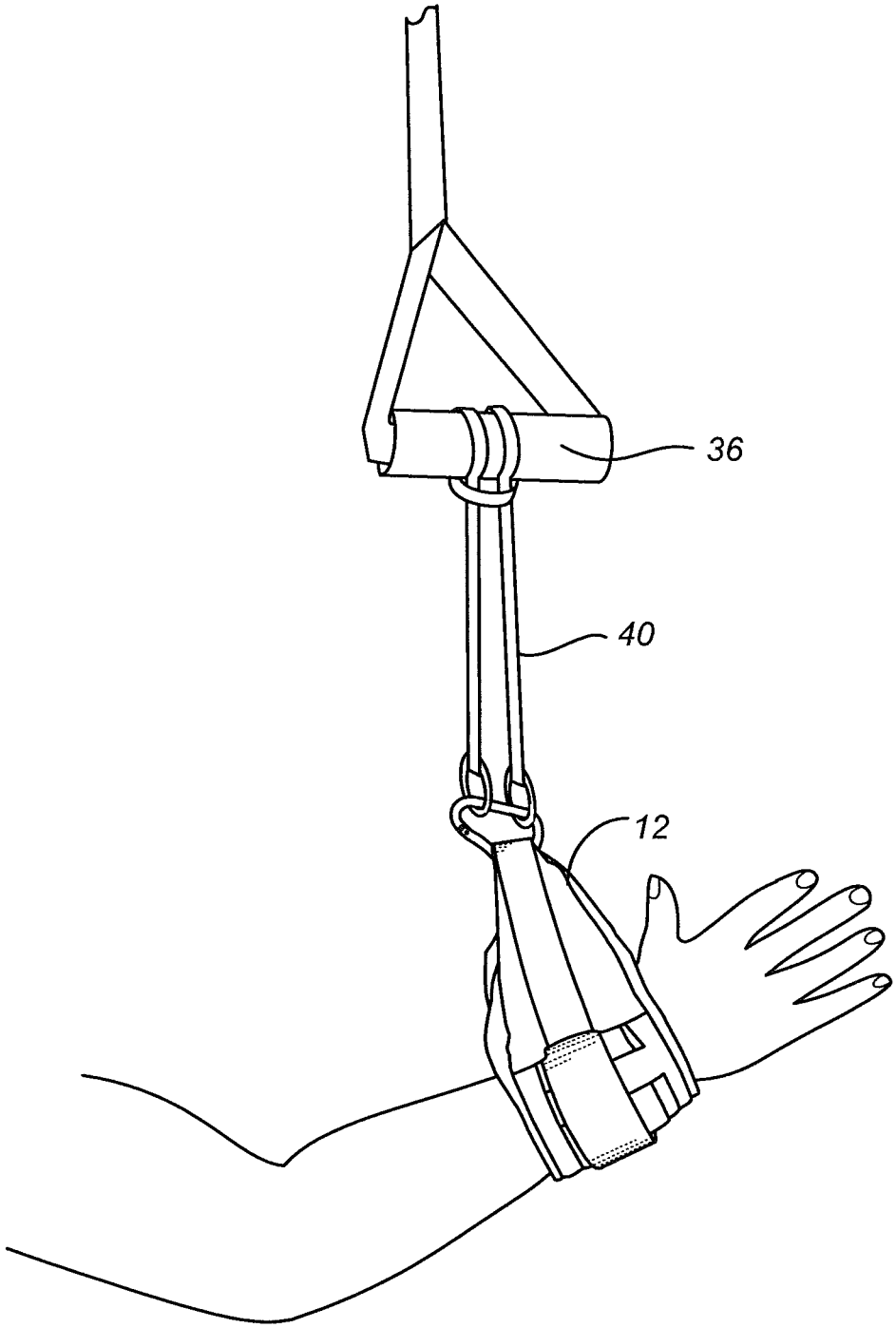
FIG. 10 shows how the double ring strap shown in FIGS. 9A and 9B can attach to the closed double loop system of the present invention.
Figure 11:
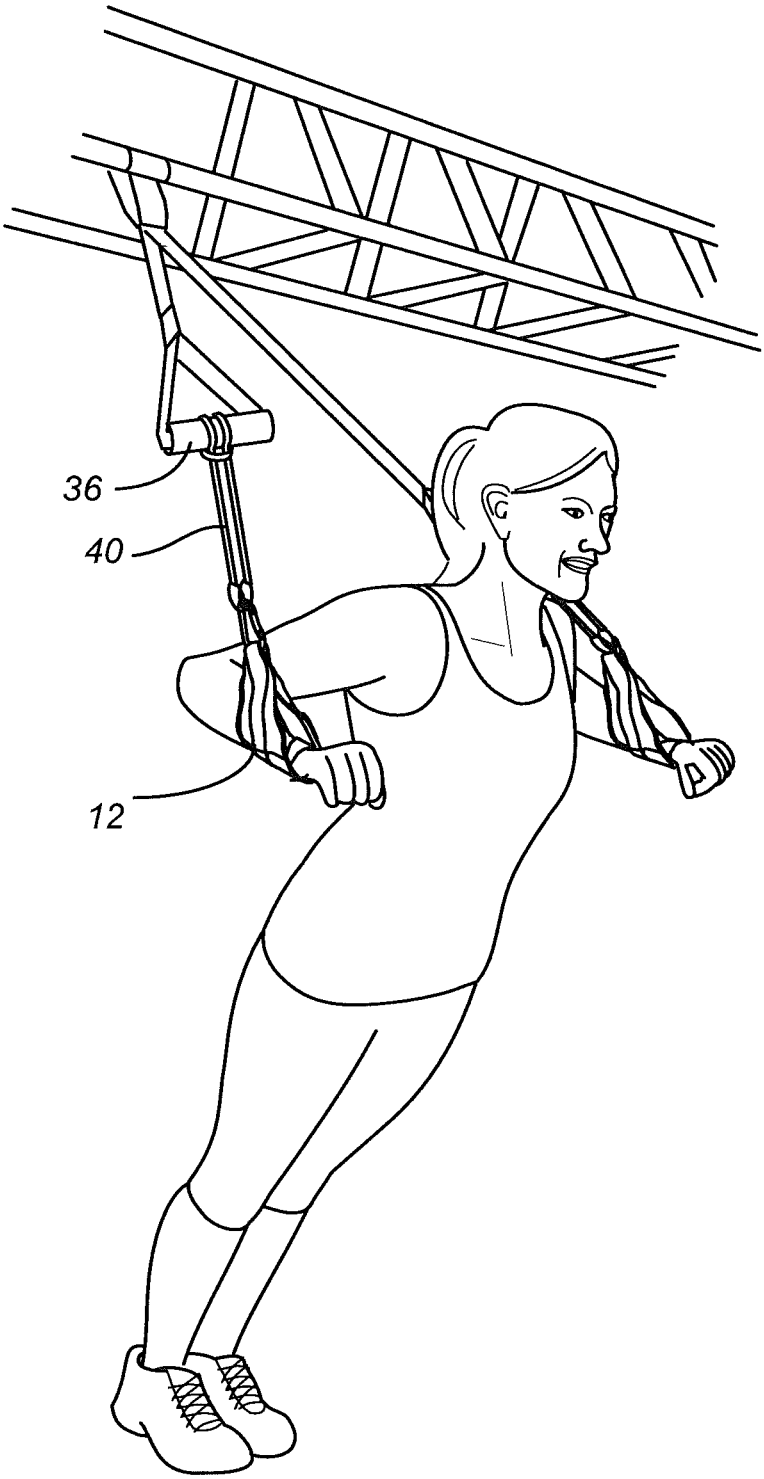
FIG. 11 shows an exerciser using both the double ring strap and closed double loop system of the present invention.

Another application of the present invention with an exercise handle 36, such as the TRX™ exercise handle, uses a two-ring strap 40 as illustrated in FIG. 9A. As shown in FIG. 10, the two-ring strap 40 can be used to connect the exercise handle 36 to a closed double loop strap 12. While an open loop, sling or handle puts a tremendous amount of pressure on the joints, the combination of handle 36, the two-ring strap 40 with a closed double loop strap 12 better avoids placing pressure, strain and stress on the joints, especially, to the elbow, ankle or knee joints. This combination of a two-ring strap 40 and closed double loop strap 12 can be used for elastic band handles, chin-up bars, barbells and dumbbells. As previously noted, the closed double loop strap 12 of the present invention transfers the suspended weight directly to the core muscle group that is of interest to build or strengthen instead of the joints.

Figure 12:
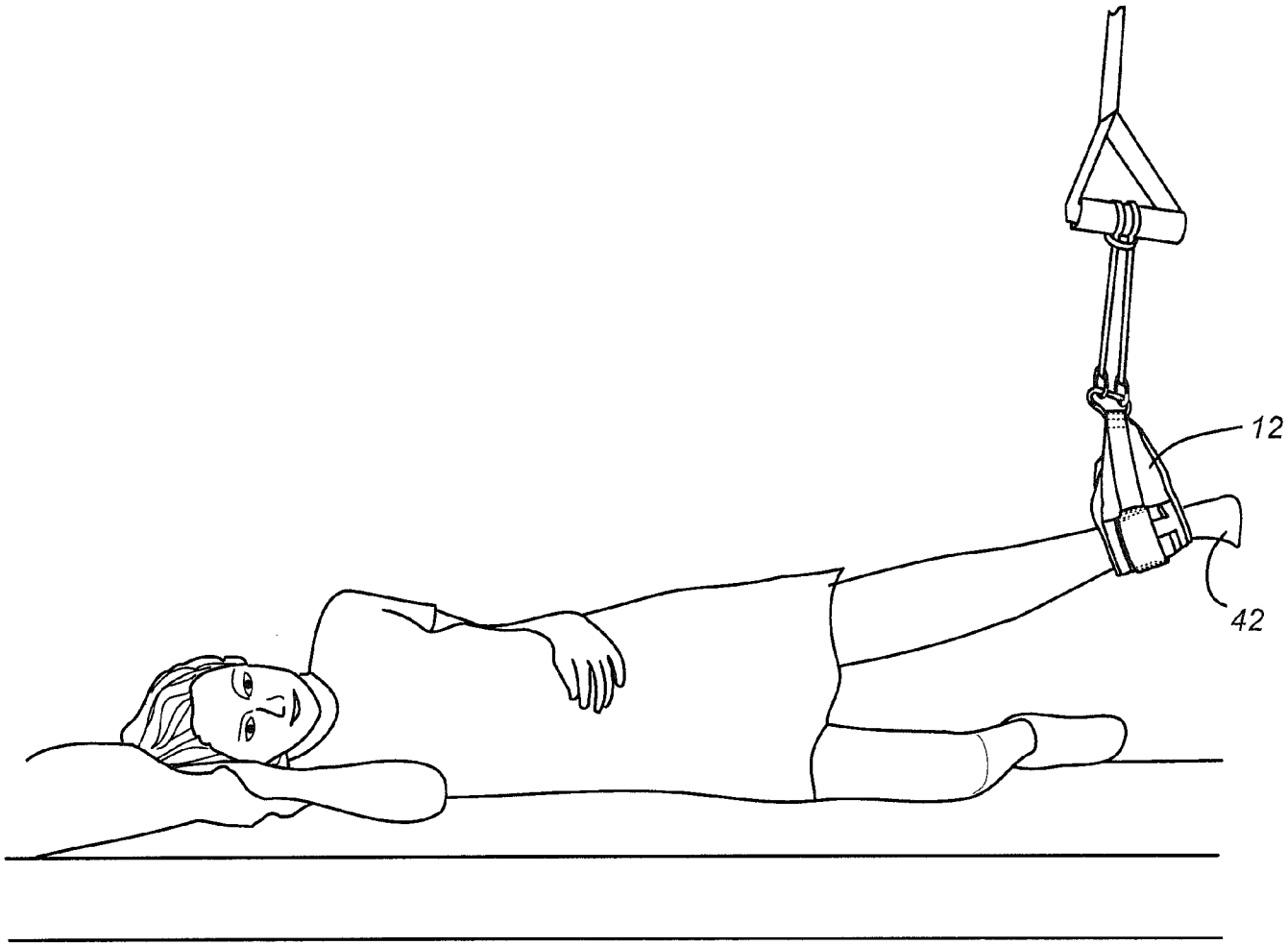
FIG. 12 shows how the double ring strap embodiment can enhance the physical therapy of a disabled person or amputee.

The closed double loop strap of the present invention can also be used for rehabilitating patients with injured joints or amputations. As shown in FIG. 12, the closed double loop strap 12 can be attached above the affected joint 42 and, thus, the proximal joints and muscles can be trained and strengthen. For instance, a patient with an amputation below the knee would previously have to do squats with a prosthesis to strengthen their hips and thighs. The amount of pressure to be endured at the stump-prosthesis interface could be so great and uncomfortable that there may be a risk of prosthetic failure and neuroma formation. The closed double loop strap 12 of the present eliminates this risk and allows for unrestricted training of the hip flexors.

Figure 13:
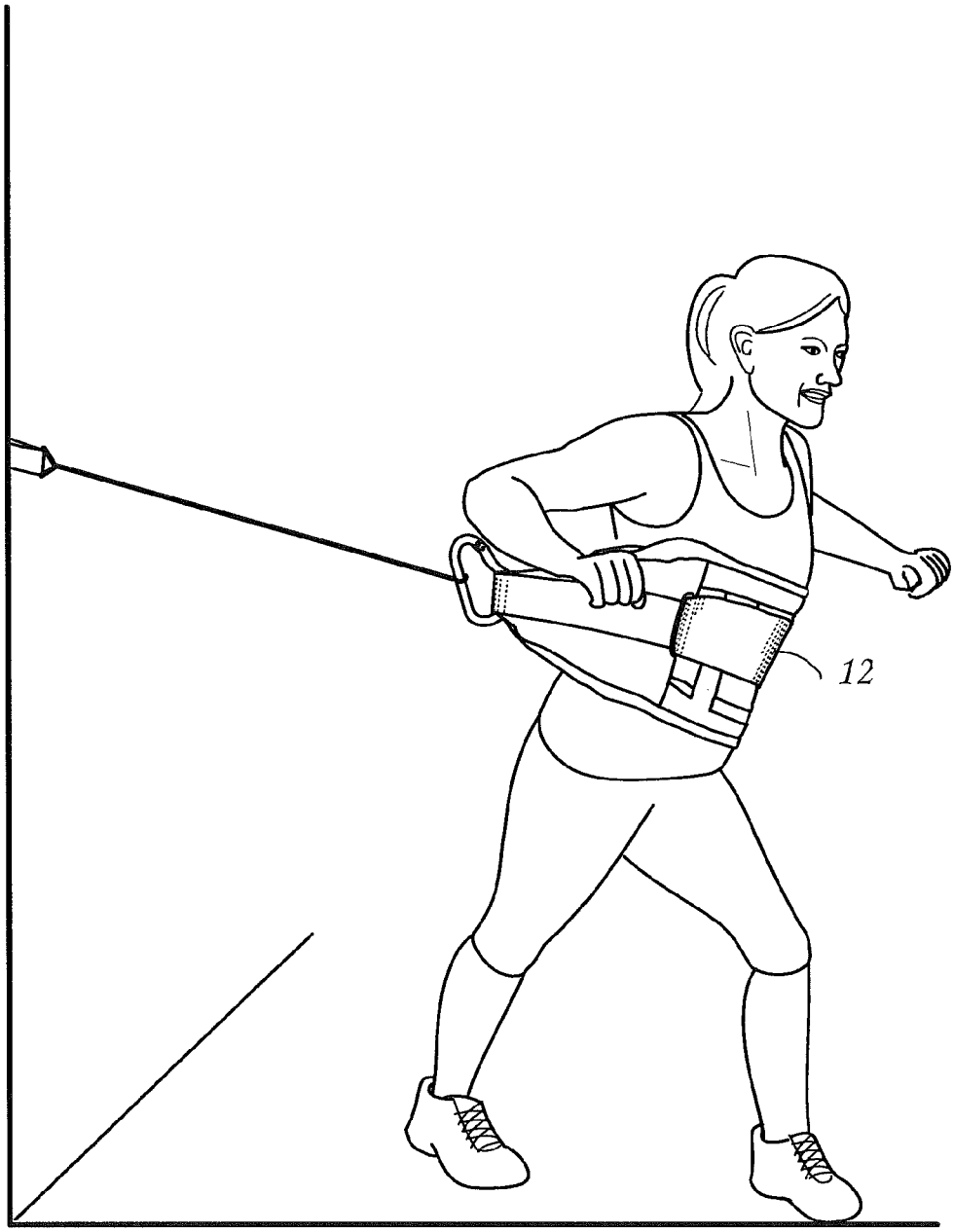
FIG. 13 illustrates how a larger version of the closed double loop system of the present invention can be wrapped around a person's torso for exercising hips and thighs.

The closed double loop strap 12 of the present invention can also be increased in size to wrap around the larger torso region as shown in FIG. 13. With this larger closed double loop strap 12, the exerciser can effectively work on their hip and thigh muscles.

Figure 14:
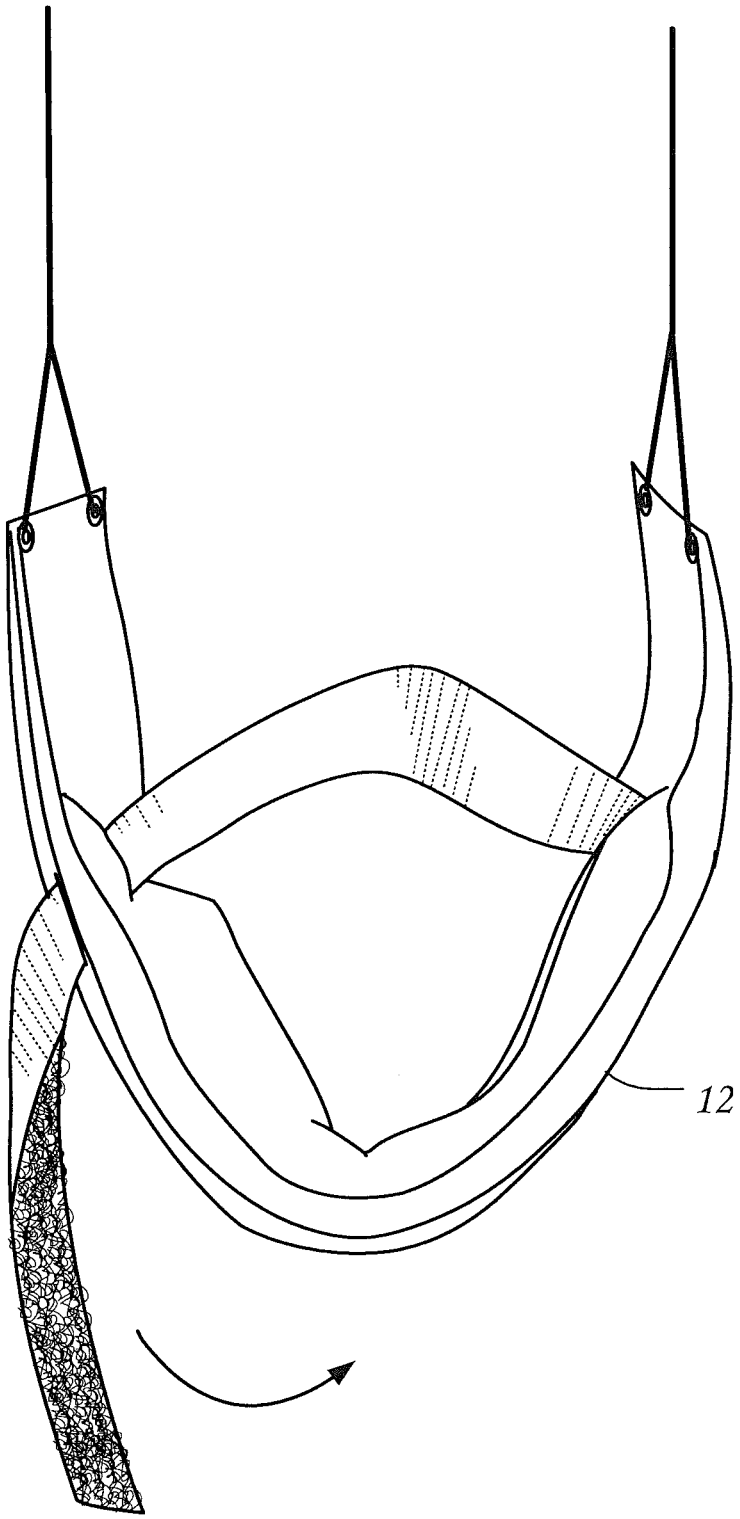
FIG. 14 shows how the closed double loop system of the present invention can be used for swings, harnesses or hoists.

As illustrated in FIG. 14, the closed double loop strap 12 of the present invention can be used in swings sets to improve safety. On a much larger scale, the closed double loop strap 12 of the present invention can be used as boat, car and/or construction hoist.

What is claimed is:

1. A double loop exercise strap comprising:

a permanently continuous outer loop having an internal surface, an external surface and a slot forming an opening through both of said surfaces;

a connector attached to said outer loop;

an adjustable strap having two ends with one end being fixedly attached to the internal surface of said outer loop and the other end being free so that said other end can be threaded through said slot to form an adjustable inner loop capable of snugly wrapping around a human limb, extremity or torso and, when so threaded, becoming attachable to the external surface of said outer loop by using a fastener.

2. The double loop exercise strap of claim 1 wherein said connector connects said outer loop to a resistance band, suspension strap, stretch strap or cable-weight strap.

3. The double loop exercise strap of claim 1 wherein said human limb, extremity or torso is inserted through said inner loop.

4. The double loop exercise strap of claim 3 wherein said inner loop can be tightened around said human limb, extremity or torso by pulling the free end of said adjustable strap after it has passed through said slot.

5. The double loop exercise strap of claim 4 wherein said fastener is selected from the group of hook and loop fasteners, buckles, snaps, clips and belts.

6. The double loop exercise strap of claim 1 wherein said continuous outer loop and adjustable strap are made from the group consisting of nylon, polyester, polyethylene fibers, aramid fibers and/or leather.

7. The double loop exercise strap of claim 1 wherein said connector is a carabineer.

8. A double loop exercise strap comprising:

a permanently continuous outer loop having an internal surface and an external surface as well as a top section, a bottom section and two side sections;

a connector attached to the top section of said outer loop;

a slot formed in one side section of said outer loop with an opening through both of said outer loop internal and external surfaces;

an adjustable strap having two ends with one end being fixedly attached to the interior surface of the side section of said outer loop opposite said slot and a free end capable of being threaded through said slot in said outer loop to form an inner loop capable of snugly wrapping around a human limb, extremity or torso and, when so threaded, becoming attachable to the external surface of said outer loop by using a hook and loop fastener.

9. The double loop exercise strap of claim 8 wherein said double loop exercise strap is part of a climbing harness or a zip line harness.

10. An exercise method comprising the steps of:

selecting a double loop exercise strap comprising a permanently continuous outer loop having an internal surface, an external surface and a slot, a connector attached to said loop, and an adjustable strap having two ends with one end being fixedly attached to the internal surface of said outer loop and the other end being free;

attaching said connector to an exercise band, dumbbell, chin-up bar or barbell;

inserting a human limb, extremity or torso into said outer loop;

wrapping the free end of said adjustable strap over said human limb, extremity or torso;

threading the free end of said adjustable strap through said slot after it has been wrapped over said human limb, extremity or torso so that it forms an inner loop around said human limb, extremity or torso;

attaching the free end of said adjustable strap to the external surface of said outer loop so that said human limb, extremity or torso is firmly secured in said inner loop by said adjustable strap;

using the exercise band to exercise once said human limb, extremity or torso is firmly secured in said inner loop.

11. The exercise method of claim 10 wherein said connector is a combination of a two ring strap attached to a carabineer.

* * * * *